United States Patent [19]

Edwards

[11] 4,158,340

[45] Jun. 19, 1979

[54] HINGED BOBBIN CASE PLATE

[75] Inventor: William J. Edwards, Cranbury, N.J.

[73] Assignee: The Singer Company, New York, N.Y.

[21] Appl. No.: 915,024

[22] Filed: Jun. 12, 1978

[51] Int. Cl.[2] ..... D05B 57/26

[52] U.S. Cl. ..... 112/231

[58] Field of Search ..... 112/231, 181, 184, 191, 112/193, 202

[56] References Cited

U.S. PATENT DOCUMENTS

| | | | |
|---|---|---|---|
| 708,771 | 9/1902 | Klogel | 112/231 |
| 1,388,114 | 8/1921 | Jackson | 112/231 |
| 2,966,130 | 12/1960 | Johnson | 112/231 X |
| 3,693,566 | 3/1972 | Ketterer | 112/184 |

*Primary Examiner*—Wm. Carter Reynolds

*Attorney, Agent, or Firm*—William V. Ebs; Robert E. Smith; Edward L. Bell

[57] ABSTRACT

A plate is provided in association with the bobbin case of a sewing machine for movement on a hinge between an open position in which the bobbin case can be readily removed from the bed of the machine, and a closed position wherein the plate holds down the bobbin case and prevents it from rotating while the machine is in operation.

5 Claims, 2 Drawing Figures

HINGED BOBBIN CASE PLATE

BACKGROUND OF THE INVENTION

1. Field of the Invention

The invention relates to bobbin case associated devices movable by a sewing machine operator between a position in which the bobbin case can be removed from the machine and a bobbin case restraining position.

2. Description of the Prior Art

Sewing machines are commonly provided with bobbin case restraining devices which serve to hold down and prevent rotation of the bobbin case during operation of the machine. However, these devices are generally difficult to manipulate between a closed bobbin case holding position and an open position permitting removal of the bobbin case from the machine bed. Furthermore, such devices when in their open position generally present some interference to removal of the bobbin case from the machine.

SUMMARY OF THE INVENTION

In accordance with the invention, a hinged plate is provided in the bed of a sewing machine in association with a bobbin case for movement as a gate between a bobbin case holding position and a position permitting easy removal of the bobbin case from the machine. The plate is of a resilient material and is provided with a pin about which the plate may be flexed when in the closed position to enable a latch to be moved into a position over the plate. The latch holds the plate down, and because of the spring action of the plate enforcing tight engagement of the plate with the latch, any tendency of the plate to vibrate during operation of the machine is avoided. Portions of the plate engageable with the bobbin case when the plate is closed prevent the bobbin case from moving vertically and from rotating when the machine is sewing.

DESCRIPTION OF THE PREFERRED EMBODIMENT

Figure 1:
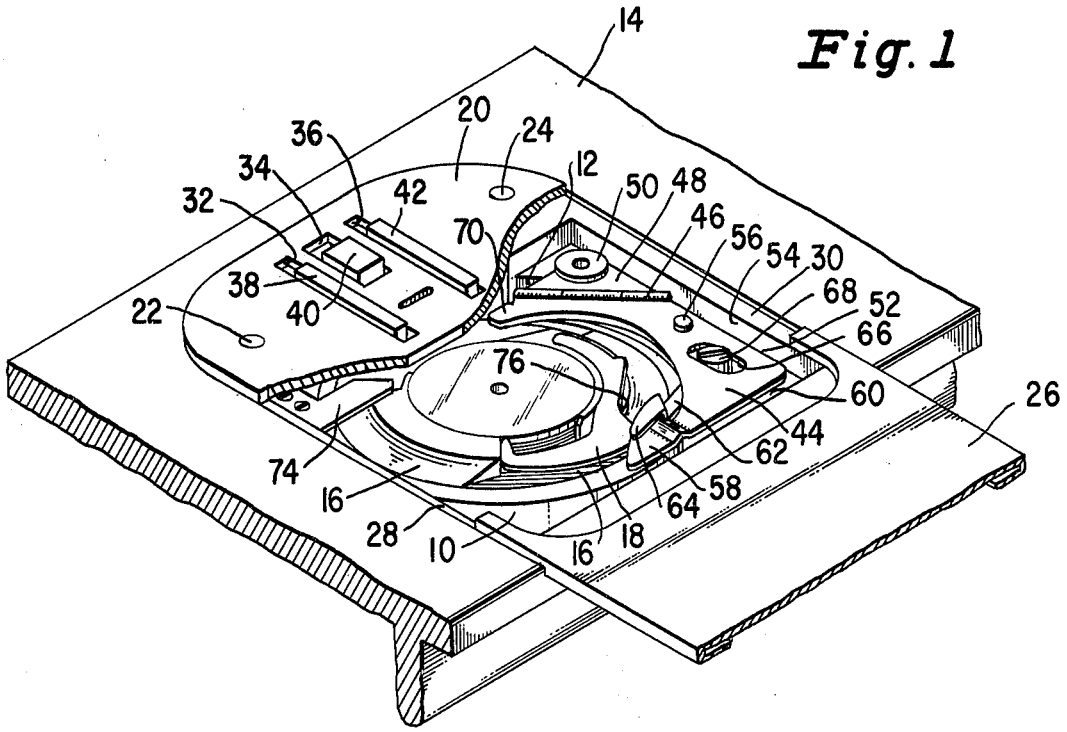
FIG. 1 is a perspective view showing a hinged bobbin case plate according to the invention in a closed position.
Figure 2:
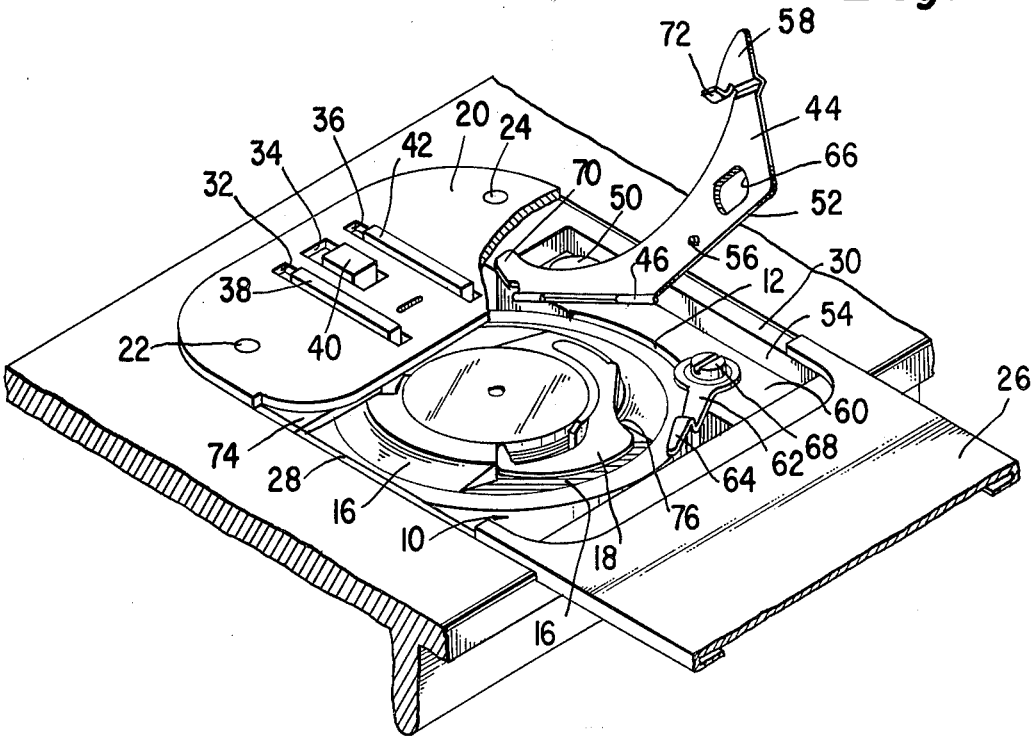
FIG. 2 is a view similar to FIG. 1 showing the bobbin case plate in an open position.

Referring to FIGS. 1 and 2 of the drawings, reference character 10 designates the loop taker of a sewing machine, which loop taker is shown within a cavity 12 in the bed 14 of the machine where it rotates in a counterclockwise direction, as viewed in the drawing, when the machine is operating. A bobbin case 16 is shown within the loop taker, the bobbin case being primarily plastic but including a metal insert 18. A throat plate 20 is mounted in the bed 14 on pins 22 and 24, and a bed slide 26 is mounted therein on rails 28 and 30 for movement between a position overlying the loop taker and bobbin case, and an open position as shown in the drawings. The bed plate is maintained closed when sewing operations are being performed, but is moved to an open position to permit removal of the bobbin case from and its subsequent return to the loop taker. The throat plate 20 includes openings 32, 34 and 36 through which feed dog elements 38, 40 and 42 respectively may extend at times to contact and move fabric when the machine is sewing.

A thin plate 44 according to the invention is provided to engage and prevent vertical and rotational movement of the bobbin case when the machine is sewing. The plate 44 is connected by a hinge 46 to a member 48, and can be moved about the hinge between a closed position (FIG. 1) and open position (FIG. 2). Member 48 is pivotally connected to the machine bed at 50. Such pivotal connection enables an operator to turn the plate slightly and avoid contact along its edge 52 with wall 54 in the bed as the plate is opened and closed.

The plate 44 is of a resilient material such as spring steel and may be flexed about a pin 56 in the plate by depressing plate end portion 58 after the plate has been moved into its closed position causing pin 56 to engage bed surface 60. Depression of end portion 58 at such time enables an operator readying the machine for sewing to move a pivoted latch 62 into a position where a tongue 64 of the latch overlies the plate 44 and locks the plate closed. As shown, the plate includes a slot 66. A screw 68 which pivotally secures the latch 62 to the bed registers with slot 66 when the plate is closed and prevents the plate from moving about the pivotal connection between member 48 and the bed at 50.

An end portion 70 of plate 44 and a finger 72 provided on the underside of the plate overlie the bobbin case 16 in the closed position of the plate and serve in conjunction with a fixed tab 74 to prevent vertical upward movement of the bobbin case when the machine is operating. The finger 72 engages an edge 76 of bobbin insert 18 and therefor also serves to prevent rotation of the bobbin case.

Plate 44 is unlocked by moving latch 62 clockwise out of its overlying position relative to the bobbin case whereupon the plate may be pivoted on hinge 46 to an open position with any accompanying movements of the plate and member 48 about the pivotal connection at 50 as required to prevent interference between wall 54 of the bed and the edge 52 of the plate. When the plate is in its open position there is free access to the bobbin case 16 and it may be easily removed with the fingers.

It is to be understood that the present disclosure relates to a preferred embodiment of the invention which is for purposes of illustration only, and that various changes and modifications may be made therein departing from the spirit and scope of the invention as defined in the appended claims.

Having thus set forth the nature of the invention, what is claimed herein is:

1. In a sewing machine, the combination comprising a machine bed having an opening therein; a circularly movable loop taker journalled in the bed in said opening; a bobbin case supported in the loop taker; a resilient plate hinged in the bed for movement as a gate downwardly into a closed position in which at least a portion overlies the bobbin case to restrain vertical upward movement of the bobbin case, and upwardly to an open position permitting removal of bobbin case from the bed, the plate including a part on the underside which engages the bed in the closed position of the plate and about which the plate may be flexed; and latch means movable over the plate in the flexed condition of the plate for locking the plate closed.

2. The combination of claim 1 wherein the hinged resilient plate includes means engageable in the closed position of the plate with the bobbin case for restraining rotational movement of the bobbin case.

3. The combination of claim 2 wherein the bed includes a member pivotally mounted in the bed for movement in a substantially horizontal plane, and the resilient plate is hinged in the bed to such pivotally mounted member for movement between its closed and open positions.

4. The combination of claim 3 including means for preventing pivotal movement of the pivotally mounted member in the closed position of the plate.

5. The combination of claim 4 wherein the means for preventing pivotal movement of said member includes a fixed element in the bed engageable with the resilient plate in its closed position.

* * * * *